US008308022B2

(12) United States Patent
Barre et al.

(10) Patent No.: US 8,308,022 B2
(45) Date of Patent: Nov. 13, 2012

(54) STOPPER WITH UNLOCKING LID AND ELASTIC RETURN

(75) Inventors: Bertrand Barre, Lapeyrouse (FR); Xavier Gibert, Chassieu (FR); Francis Lepage, Dommartin (FR)

(73) Assignee: The Zebra Company, Limonest (FR)

( * ) Notice: Subject to any disclaimer, the term of this patent is extended or adjusted under 35 U.S.C. 154(b) by 790 days.

(21) Appl. No.: 10/559,456

(22) PCT Filed: Jun. 7, 2004

(86) PCT No.: PCT/FR2004/001407

§ 371 (c)(1),
(2), (4) Date: Feb. 9, 2006

(87) PCT Pub. No.: WO2004/110889

PCT Pub. Date: Dec. 23, 2004

(65) Prior Publication Data

US 2007/0000955 A1 Jan. 4, 2007

(30) Foreign Application Priority Data

Jun. 6, 2003 (FR) ..... 03 06867

(51) Int. Cl.

| | |
|---|---|
| ***B65D 51/16*** | (2006.01) |
| ***B65D 43/14*** | (2006.01) |
| ***B65D 51/04*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |

(52) U.S. Cl. ..... 220/847; 220/360; 220/834; 220/837; 215/237

(58) Field of Classification Search ..... 220/360, 220/834, 837, 847; 215/237
See application file for complete search history.

(56) References Cited

U.S. PATENT DOCUMENTS

| | | | | |
|---|---|---|---|---|
| 3,826,394 | A * | 7/1974 | Stull | 215/224 |
| 4,209,100 | A * | 6/1980 | Uhlig | 215/216 |
| 4,392,055 | A * | 7/1983 | Whitney | 215/307 |
| 4,513,888 | A * | 4/1985 | Curry | 222/153.14 |
| 4,782,964 | A * | 11/1988 | Poore et al. | 215/216 |
| 4,782,985 | A | 11/1988 | Kinsley | |
| 5,031,784 | A * | 7/1991 | Wright | 215/216 |
| 5,551,607 | A | 9/1996 | DeJonge, Sr. et al. | |
| 5,573,127 | A | 11/1996 | Takahashi et al. | |
| 5,605,254 | A * | 2/1997 | Wagner et al. | 222/108 |
| 5,762,216 | A | 6/1998 | Takeuchi | |
| 6,409,034 | B2 * | 6/2002 | Schorner | 215/237 |
| 6,460,712 | B2 * | 10/2002 | Smith et al. | 215/235 |

FOREIGN PATENT DOCUMENTS

| | | |
|---|---|---|
| EP | 0 379 775 A1 | 8/1990 |
| GB | 969 193 | 9/1964 |

* cited by examiner

*Primary Examiner* — Anthony Stashick
*Assistant Examiner* — Andrew T Kirsch
(74) *Attorney, Agent, or Firm* — Oliff & Berridge, PLC

(57) ABSTRACT

A stopper for application to a container of the type with a base, an emptying duct, a lid, mounted on the base to pivot between an open and a closed position, a hinge with elastic return which holds the lid in the open position thereof and locking means, for locking the lid on the base. The stopper comprises positive unlocking means for the lid from the base, which are manually operated to provide a force to disengage the holding means. The base is a unitary construction and made from plastic material, the lid is made from the same plastic material and the leaf of the hinge is in an elastomeric plastic material.

23 Claims, 5 Drawing Sheets

STOPPER WITH UNLOCKING LID AND ELASTIC RETURN

The present invention relates to the stoppering of a container, particularly a single-use or disposable container, the internal volume of which may contain contents (or a fill) capable of flowing, so therefore liquid, fluid or pasty.

More particularly, the present invention relates to a stopper intended to be mounted on a container as defined hereinabove, particularly sealedly with respect to the contents of said container.

The invention also relates to a container comprising or incorporating such a stopper, empty or full, that is to say filled with contents as defined hereinabove.

Document U.S. Pat. No. 5,762,216 (cf. FIG. 13a, 13b, 14a, 14b) has described a stopper comprising:

- a base comprising mounting means (by screwing) for mounting on a container, particularly its neck sealable with respect to the contents of said container, and a discharge duct designed to communicate with the internal volume of the container in order to discharge its contents, comprising an outlet orifice for letting said contents out,
- a lid comprising shut-off means in the form of a nipple designed to close the outlet orifice of the base in a way that is sealed with respect to the contents of the container,
- articulation means for articulating the lid with respect to the base, between an open position in which the outlet orifice of the base is uncovered, and a flipped-down position in which said outlet orifice is closed; these articulation means comprise a spring-back hinge comprising a part made of viscoelastic material, of the elastomer type, attached and mounted between the base and the lid and which therefore joins these items; this viscoelastic part is stressed when the lid is in its position in which it is flipped down onto the base, and urges the lid to spring back toward the open position,
- retaining means for locking the lid on the base, in its flipped-down position, consisting in part of a tight fit, with friction, between the base and the lid; a cut-out is formed on the base and allows a predetermined force to be exerted directly and by hand between said lid and the base in order to disengage these items one from the other and free the hinge to urge the lid to the spring-back position.

According to U.S. Pat. No. 5,762,216 it is very difficult to attain the stopper-open position using just one hand. In order to open the lid, under the effect of the spring back of the hinge, it is in fact necessary to hold the container with the stopper in one hand, and engage a finger from the other hand in the cut-out provided for this purpose on the lid in order to exert the force required to overcome the friction between the base and the lid.

Document EP-A-0 379 775 describes a stopper intended to be mounted on a container, differing from the preceding one in that:

- the shut-off means on the lid consist of a tubular element collaborating with the interior of the outlet orifice belonging to the base,
- the articulation means articulating the base and the lid to one another comprise no spring-back means urging the lid to spring back to the open position,
- the retaining means, that is to say the means for locking the lid in the position in which it is flipped down onto the base, consist of two complementary clip-fastening means arranged one on the aforementioned tubular element that shuts off the outlet orifice and one inside the latter, it being understood that there is no or very little tendency of the hinge in the flipped-down and retained (or latched) position to spring back to the open position,
- means for separating the lid from the base, the lid nonetheless remaining in its position in which it is flipped down and locked by the retaining means; these means are positioned between the base and the lid and are arranged, for example with a ramp, to be actuated by hand and exert a limited thrust on the lid with respect to the base, that is just strong enough to create a gap between the base and the lid and allow the latter to be grasped by its edge.

According to EP-A-0 379 775, it is not possible to attain the stopper-open position using just one hand. To open the lid it is actually necessary to hold the container with the stopper in one hand, and, using a finger of this same hand, generate the gap between the lid and the base, at the same time actuating the separating means defined hereinabove. Then, using the other hand, it is necessary to grasp hold of the lower edge of the lid, than raise the latter manually in order, by pivoting the articulated lid, to attain the position in which the outlet orifice is fully open.

The subject of the present invention is a stopper of the type described hereinabove, substantially improving its opening ergonomics in that it makes it possible, using just one hand, both to grasp the container and to completely open the stopper, for example in order to gain direct access via the user's mouth, to the outlet orifice or spout of the base.

According to the present invention, the predetermined unlatching force that needs to be exerted between the lid and the base in order to disengage the lid with respect to the base and free the hinge to urge the lid to the spring-back position is taken into consideration.

Further, according to the invention, the stopper further comprises positive means of unlatching between the base and the lid, these being designed to be actuated manually by exerting an opposing force between said base and the lid, at least equal to the unlatching force of the retaining means that hold the lid in its flipped-down position.

By virtue of the invention it becomes possible to take hold of the container with its stopper in just one hand and, using a digit of this same hand, for example the thumb, to actuate the positive unlatching means in order automatically to attain the position in which the outlet orifice of the base is wide open and free of any impediment to its being accessed, by the mouth for example.

The present invention also presents, by way of example, the following technical characteristics.

The hinge comprises at least two articulation leaves situated one on either side of the web of viscoelastic material, for example elastomer, and which are molded as an integral part of the lid and the base.

As a preference, each articulation leaf comprises a central part and at least two articulation regions on each side of the central part.

This particular, although non-exclusive, embodiment of the present invention in particular affords the following advantages:

- by virtue of the lateral leaves, the rotational or pivoting movement of the lid with respect to the base is guided in a plane passing through the axis of the discharge duct or of the outlet orifice of the base; in particular, the shut-off means are brought coaxially with respect to the aforementioned axis into the position in which the lid is flipped down;

by virtue of the two articulation regions, each articulation leaf determines, on each side of the web or of the piece of viscoelastic material, a multiple articulation hinge allowing the shut-off means to be fitted axially into the outlet orifice, toward the position in which the latter is flipped down;

by limiting the amount of plastic formed as an integral part of the molding process that makes up the articulation leaves, the creep resulting from the repeated movements of the articulation means or of hinge from the open position to the flipped-down position and vice versa is limited; furthermore, the kind of fit that can be achieved with this material allows the final and angular position of the lid, in opening, to be regulated or controlled together with the speed at which it moves from the flipped-down position into the wide open position under the spring-back effect of the hinge;

although the aforementioned stopper is produced by injection-molding a thermoplastic, the shut-off means positioned on the lid shut off or seal with great precision, and therefore sealedly, the outlet orifice of the base, when the lid is in the flipped-down position; the sealing thus obtained may allow a fizzy beverage to be contained in the container, for example, by affording sealing also with respect to the gaseous phase of said beverage.

Any adhesion there might be between the two articulation leaves and the two respective side faces of the viscoelastic web allows the hinge to be structured and in particular given torsional and tensile strength, and for this to be achieved using very little thermoplastic.

Positive unlatching means comprise:

at least one ramp belonging to the lid or to the base, a manually actuable elastic deformable flap belonging to the base or to the lid, comprising a free end intended to slide along the ramp for creating an opposing force at least equal to the force required to unlatch the means for retaining the lid in its flipped-down position, the ramp being arranged in relation to the free end of the flap which comes into contact therewith in such a way as to exceed beyond the relative position in which the lid is in its flipped-down position, but disengaged from the base.

The base comprises an air intake separate from the discharge duct, designed to allow air to enter the container in response to the dispensing of its contents via the outlet orifice.

For example, this air intake comprises at least one external groove formed on the base, which runs at the intersection between the latter and a more or less radial plane, running, on one side, at least from the foot of the discharge duct and, on the other side, along the duct as far as the outlet orifice.

The viscoelastic component joining the lid and the base consists of a web running between two ends that are connected directly, for example by adhesion, to the base and to the lid respectively. This web is for example obtained by molding or two-shot injection molding, respectively, of a thermoplastic making it possible to obtain at least the base and the lid and possibly the articulation leaves as a single integral part, and an elastomeric material to form the web.

Other characteristics and advantages of the present invention will become apparent in the course of the following description of several embodiments which are given by way of nonlimiting example with reference to the attached drawings in which.

In the manner of FIGS. 1 to 4, FIGS. 7 to 10 depict a second embodiment of the stopper according to the invention, in the open position, in perspective and in cross section, in the intermediate position and in the flipped-down position, respectively.

Figure 11:
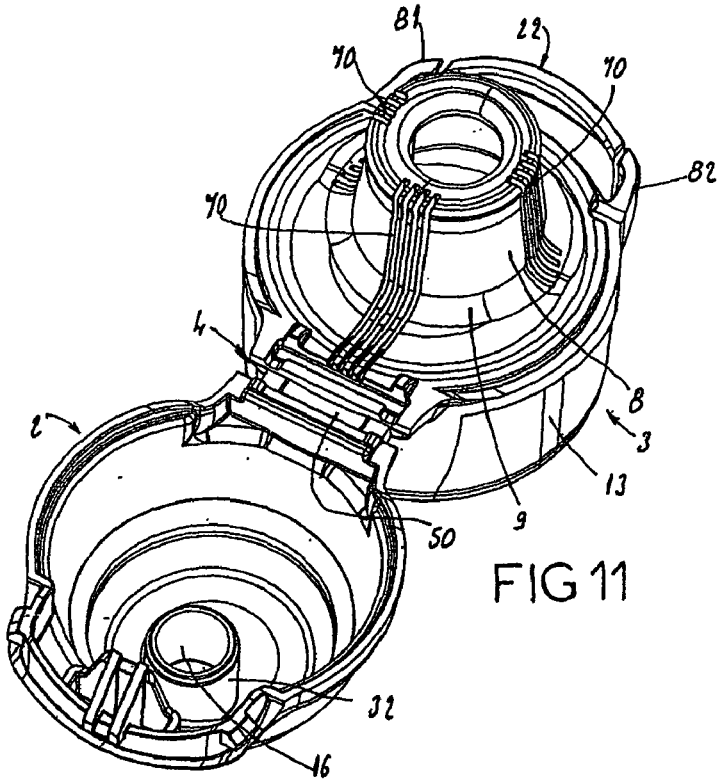

FIG. 11 depicts a third embodiment of the stopper according to the invention in the open position.

The stopper 1 according to the present invention and depicted in FIGS. 1 to 4 comprises, in a way known per se, a base 2, a lid 3 mounted articulated on the base 2, and a spring-back hinge 4 which allows the lid 3 to pivot about an imaginary axis on the base 2, as determined by the articulation means described hereinafter.

Figure 2:
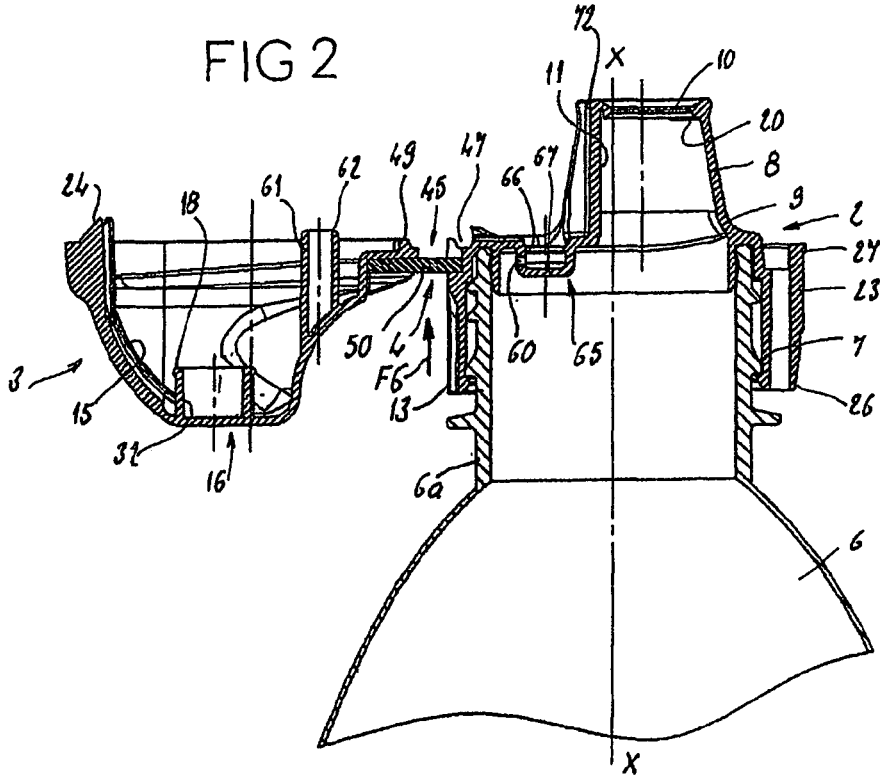
FIG. 2 is a view in cross section of the stopper of FIG. 1, mounted on a container in the open position.

The base 2 is, for example, cylindrical and intended to be mounted for example by screwing or alternatively by any other mounting means, removably or non-removably, on the neck 6*a* of a container 6 as shown partially in FIG. 2. In the figures, the base 2 is attached to the neck 6*a* of the container 6 by clip-fastening elements 7 or alternatively by an internal screw thread which collaborates with the neck. The mounting means adopted allow for sealing between the stopper 1 and the container 6 with respect to its contents.

Furthermore, the base 2 has a discharge duct 8 which communicates with the internal volume of the container 6 to discharge the contents of this container when the lid 3 is opened. The duct 8 runs between a foot 9 secured to the base 2 and an opposite outlet orifice 10.

The base 2 is formed of an annular rim 12 which runs more or less transversely to the longitudinal axis X-X of the container 6, and of a skirt 13 which runs toward the container 6, parallel to the neck of this container. The foot 9 of the discharge duct 8 is thus formed as an integral part of the annular rim 12 of the base. The shape of the base 2 is also tailored, for example, to direct access by the user's mouth to the outlet orifice 10.

Figure 1:
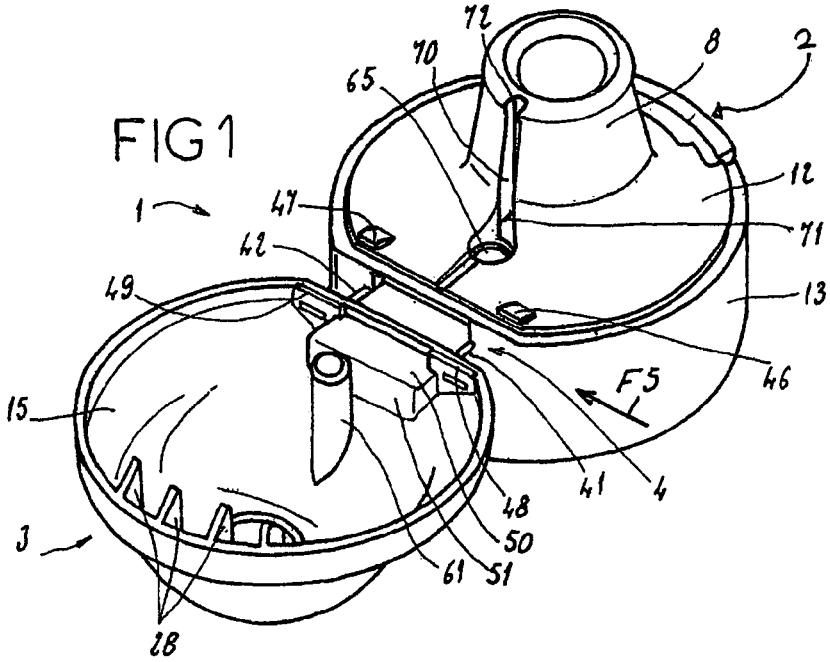
FIG. 1 is a perspective view of a first embodiment of the stopper according to the present invention, the lid being in the open position.

The lid 3 is mounted articulated on the base 2 and, more specifically, on the annular rim 12 of this base, between a wide open position as depicted in FIGS. 1 and 2 in which the outlet orifice 10 of the duct 8 is completely uncovered, and a flipped-down position in which this outlet orifice 10 of the duct 8 is closed off. The lid 3 is of concave shape, with the concave face facing toward the annular rim 12 of the base 2, and has an interior face 15. Shut-off means 16 project from the interior face 15 to shut off the outlet orifice 10 of the duct 8 when the lid 3 is in the position in which it is flipped down onto the base 2.

The spring-back hinge 4 is formed of a thin web 50 of elastomeric material running between the edge of the lid 3 and the skirt 13 of the base 2, near the level defined by the annular rim 12. This hinge 4 is stressed when the lid 3 is in the position in which it is flipped down onto the base 2, and urges this lid to spring back toward its open position, particularly its wide open position.

In order to keep the lid 3 in the position in which it is flipped down onto the base 2, the stopper comprises retaining means which are either means that achieve a tight fit or are nested together forcibly, or clip-fastening means as described hereinafter.

According to the present invention, the stopper 1 also possesses positive unlatching means 22 for unlatching the lid 3 from the base 2, these means 22 being actuated by hand by the user in order to create an opposing force able to disengage said retaining means.

All the constituent parts of the base 2 are formed as an integral part and made of a plastic such as polypropylene or alternatively polyethylene.

Likewise, according to one characteristic of the present invention, the lid 3 is made as one piece and produced from the same plastic as the base 2 so that the lid 3 is also produced in polypropylene or alternatively in polyethylene. Only the web 50 of the hinge 4 is made of an elastomeric plastic, so as to obtain the spring-back effect that causes the lid 3 to spring back into an open position. Thus, by virtue of the present invention, the closing of the lid 3 onto the base 2 is obtained dependably, while the opening of the lid 3 is obtained by virtue of the positive unlatching means 22 which generate an opposing force directed away from the container 2 to allow the retaining means to disengage and thus the lid 3 to spring back automatically to the open position by means of the spring-back hinge 4.

According to the present invention, this opposing force exerted between the base 2 and the lid 3 is at least equal to the force required to unlatch the retaining means (18, 20) that keep the lid in its position in which it is flipped down onto the base, and therefore to disengage the lid from the base, then release the stress in the hinge to allow it to spring back.

Figure 3:
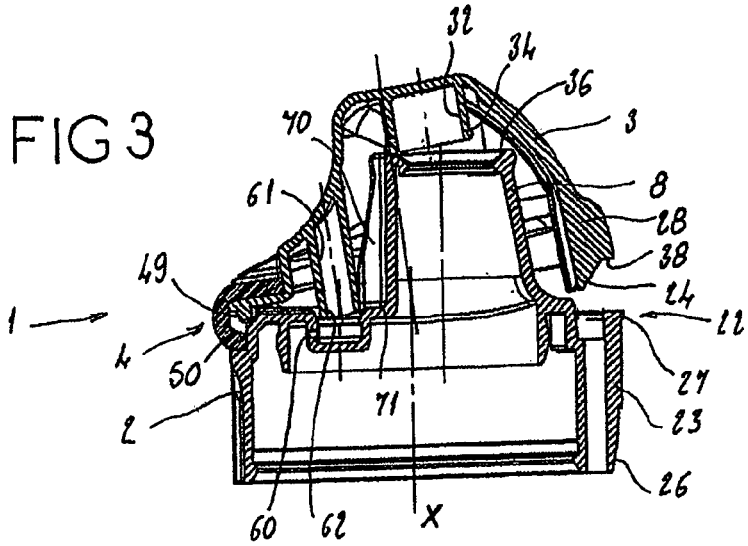
FIG. 3 is a view in cross section of the stopper of FIG. 1, the lid being in its intermediate position between the open position and the flipped-down position.
Figure 4:
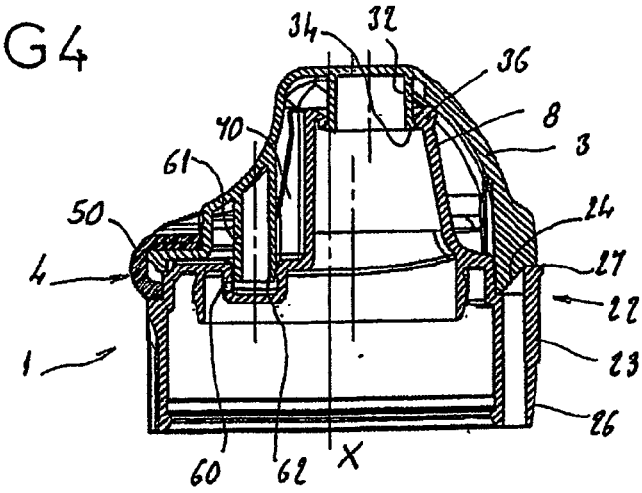
FIG. 4 is a cross section through the stopper of FIG. 1, the lid being in the position in which it is completely flipped down onto the base.
Figure 5:
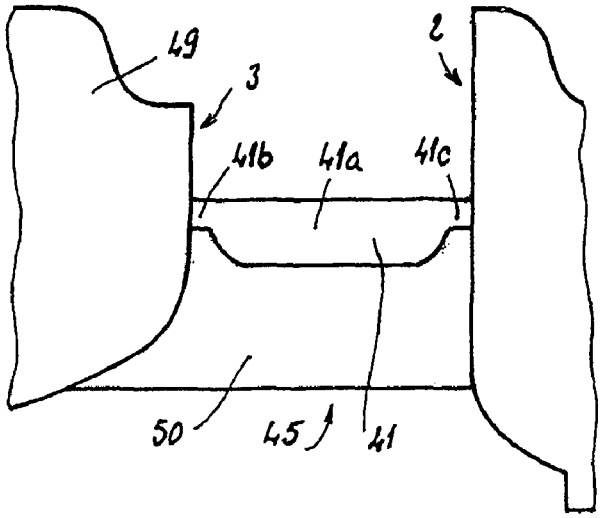
FIG. 5 is a side view, in the direction of the arrow F5 shown in FIG. 1, of a detail of the articulation means or hinge of the stopper according to FIG. 1.
Figure 6:
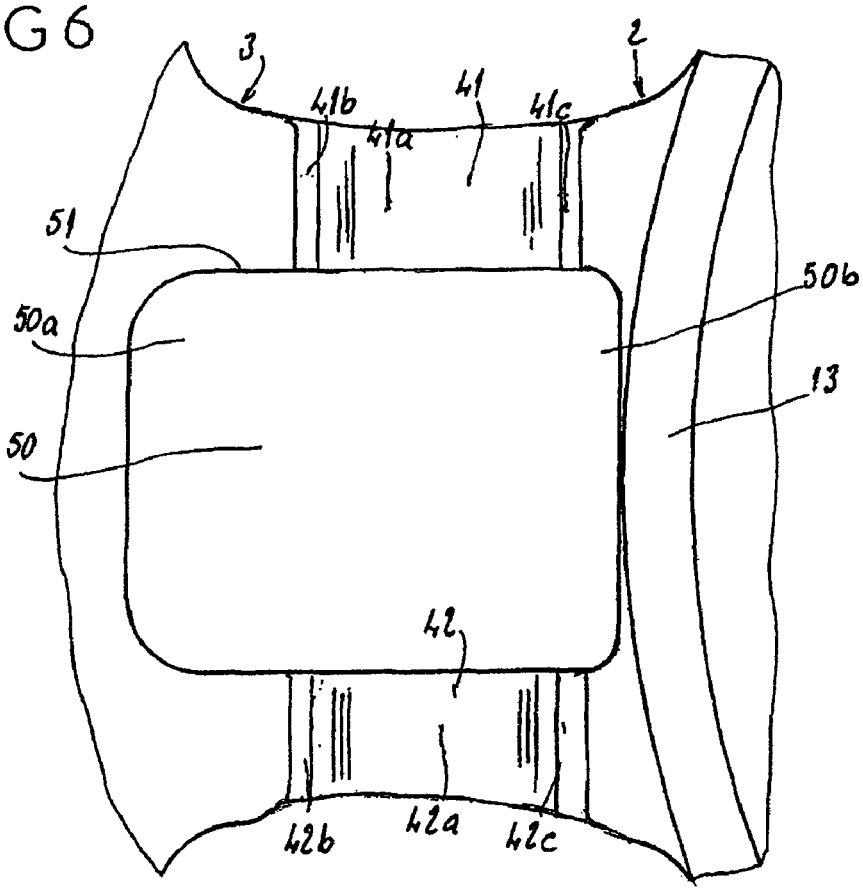
FIG. 6 is a view from underneath, in the direction of the arrow F6 shown in FIG. 2, of the same detail as that shown in FIG. 5.
Figure 7:
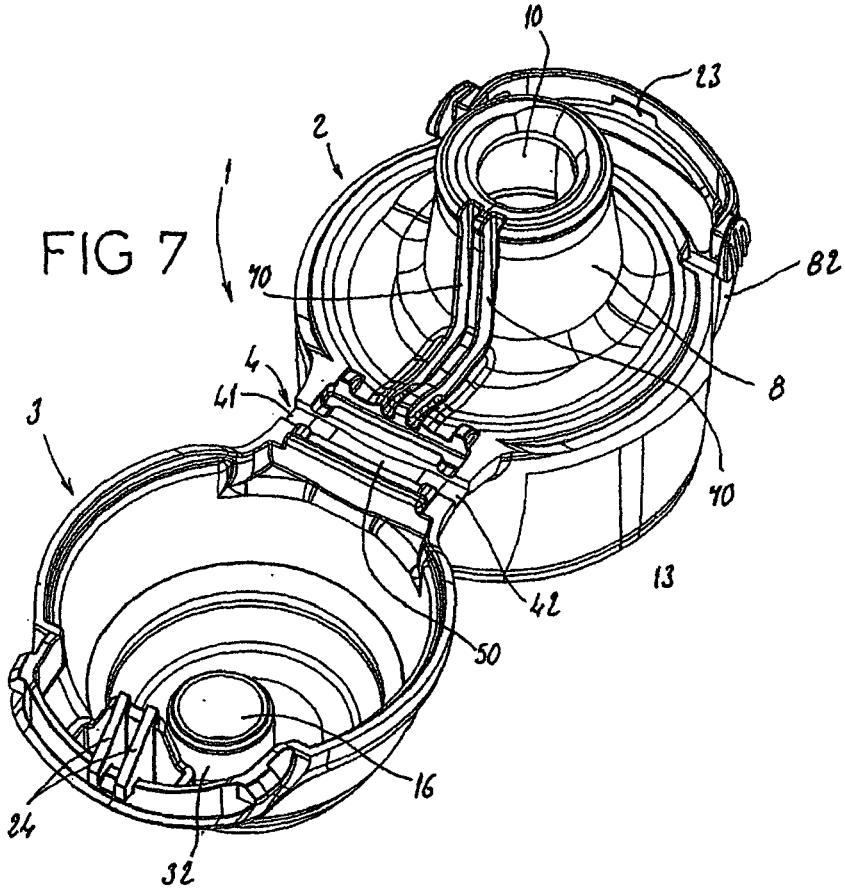
Figure 8:
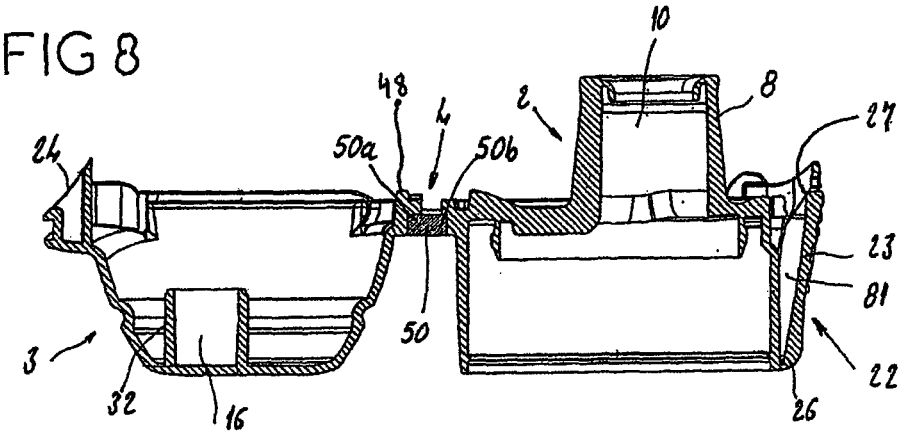
Figure 9:
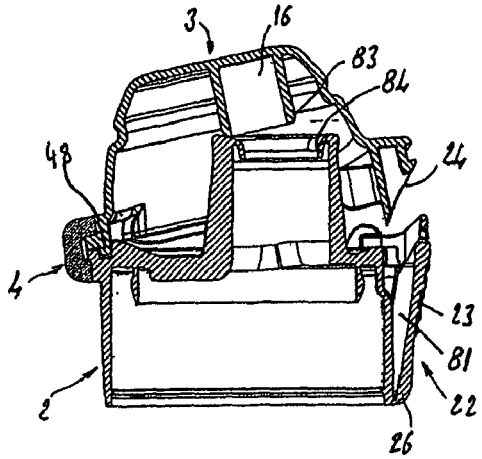
Figure 10:
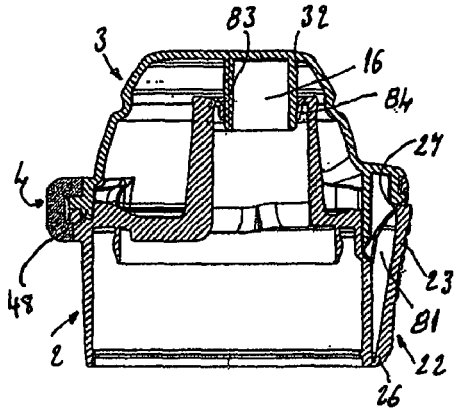

As shown more particularly in FIGS. 2 to 4, the unlatching means 22 consist of an elastically deformable flap 23 and of at least a ramp 24 formed as an integral part of the lid 3.

The deformable flap 23 has a first end 26 integral with the skirt 13 of the base 2, being formed as an integral part thereof, and a second end 27 which is free and intended to slide along the ramp 24 to generate the opposing force required to unlatch the retaining means 18, 20.

The deformation of the flap 23 consists in a centripetal pivoting thereof, about the fixed end 26, in order to move the free end 27 toward the center of the stopper, against the tendency of said flap to return elastically to its original position, incorporated within the periphery of the skirt 13.

The ramp 24 is directed toward the outside of the stopper 1 and away from the base 2 so as to define a surface that diverges upward and outward when the lid 3 is in the flipped-down position (cf. FIG. 4). For preference, the lid 3 has three ramps 24 each defined at the ends of three flanges 28 each of which projects from the interior face 15 of the lid 3, these being spaced apart. The distance between the first and the third of these flanges is more or less equal to the width of the deformable flap 23, so that the free end 27 of this flap bears simultaneously on all the ramps 24 borne by these flanges.

For preference, the deformable flap 23 and the ramps 24 are situated diametrically opposite the spring-back hinge 4.

The deformable flap 23 runs in the continuity of the volume defined by the skirt 13. Thus, the flap 23 is installed at a narrowing of this skirt 13, and is kept away from the walls of this skirt so that it can be deformed transversely to the axis X-X of the stopper. The flap 23 is connected to the walls of the skirt 13 only at its first end 26, which forms a kind of axis of pivoting for this flap.

To make it easier for the free end 27 to slide along the ramps 24, this free end 27 is preferably chamfered so as to define an area of contact between this end and the ramps 24.

In an alternative, the ramp 24 may be borne by the flap 23, while the lid 3 bears a straight part located opposite to slide along this ramp.

Each of the ramps 24 is positioned in relation to the free end 27 of the flap 23 not only to convert the manual thrust on said flap into an opposing force, as defined hereinabove, but also so that, still under the effect of the manual thrust, it extends beyond the relative position of the ramps 24 in sliding contact with the free end 27 of the flap 23 in which position the lid 3 is in its flipped-down position, but disengaged from the base 2, that is to say after the retaining means (18, 20) have been unlatched.

For preference, the retaining means comprise clip-fastening means 18 borne by the lid 3 and complementary clip-fastening means 20 borne by the base 2, so that they can collaborate with each other.

The clip-fastening means 18 may be installed at any point on the stopper, for example on the flap 23, the base 2 or on the lid 3, but in this case are preferably borne by the shut-off means 16 intended to shut off the duct 8. Likewise, the complementary clip-fastening means 20 are borne by the interior face 11 of the duct 8, at the outlet orifice 10.

The shut-off means 16 for the duct 8 consist of a tubular element 32 formed as an integral part of the interior wall 15 of the lid 3. This tubular element 32 extends over a short height by comparison with the overall dimensions of the lid 3 and has an outside diameter more or less equal to the inside diameter of the duct 8.

The clip-fastening means 18 adopt the form of a periphery annular collar 34 which extends out from the tubular element 32, at its free end, while the complementary clip-fastening means 20 consist of an annular bulge 36 which runs around the interior wall 11 of the duct 8, at the outlet orifice 10.

The annular collar 34 and the annular bulge 36 each have a chamfer to make it easier to clip them together when the lid 3 is flipped down onto the base 2. Their respective locations are also tailored so that the clipping of the bulge into the collar occurs when the free end 27 of the flap 23 comes into contact with the ramps 24 of the lid 3. To achieve this, these ramps 24 are extended by a rim 38 which runs more or less transversely to the axis X-X to abut against the free end 27 of the deformable flap 23.

Thus, not only do these clip-fastening means consisting of the bulge 36 and the collar 34 allow the lid to be kept in the latched position, but they also seal the stoppering of the duct 8 with respect to the contents of the container 6. This sealing is enhanced if the rigidity of the walls of the tubular element 32 is adapted with respect to the walls of the duct 8. For preference, the rigidity of the tubular element 32 is inferior to that of the duct 8. This difference in rigidity is obtained by virtue of different wall thicknesses for these walls, in as much as they are made of the same material, or alternatively by using ribs. When the stopper is closed, any gas contained in the container generates a certain pressure which acts on the walls of the tubular element 32 to press them more firmly still against those of the duct 8, thus further enhancing the sealing with which the orifice 10 is shut off.

As a variant, the retaining means (18, 20) may be means for simply pushing the tubular element 32 firmly into the duct 8, this element being of outside diameter slightly greater than the inside diameter of the duct 8. Furthermore, the tubular element may be a frustoconical shape.

As shown more particularly in FIG. 1, the hinge 4 has, on each side of the web 50 of elastomeric material, two leaves 41 and 42 which are contiguous and adhere to the two side faces of the web respectively and run between the lid 3 and the base 2. These leaves are formed as an integral part of the lid 3 and of the base 2.

The two leaves 41 and 42 are therefore made of polypropylene or of polyethylene and have a cross section far smaller than that of the web 50 of the hinge 4, by a factor of around 10. This prevents any creep of the material and allows the hinge 4 to retain its spring-back effect, even when the lid 3 is placed in the position in which it is flipped down onto the base 2 for a lengthy period of time. The leaves are also small in thickness.

As a preference, the stopper is obtained by molding or two-shot injection molding, respectively, a thermoplastic to yield at least the base 2, the lid 3 and the leaves 41 and 42 as a one-piece part, and an elastomeric material to obtain the web 50.

This hinge 4 is able to cause the lid 3 to pivot toward it open position, over an angular travel of at least 150° with respect to the flipped-down position.

Furthermore, the stopper 1 has guide means 45 for accompanying the pivoting of the lid 3 from its open position to its flipped-down position. These guide means consist in two dogs 46 and 47 which delimit two cradles on the base 2, and of two bosses 48 and 49 on the lid 3, that complement the shape of the cradles.

The two dogs 46 and 47 are formed as an integral part of the annular rim 12 of the base 2, on each side of the two leaves 41 and 42. They define an imaginary axis of rotation to accommodate, on the base 2, the two bosses 48 and 49 of the lid 3 at the end of travel of the lid 3 toward its flipped-down position.

The two bosses 48 and 49 are formed as an integral part of the edge of the lid 3, to correspond with said two cradles 46 and 47.

Thus, rotational guidance of the lid is further improved, making it possible to compensate for any twisting there might be of the web 50 of the hinge 4.

A stopper 1 as described hereinabove is obtained, in the wide open position shown in FIG. 2, directly by two-shot injection molding of, on the one hand, the plastic, for example thermoplastic, of which the base 2, the lid 3 and the articulation arms 41 and 42 are made as one single part and, on the other hand, the elastomeric material that forms the web 50. Thus, the web 50 adopts the form of a tab of which the end 50*a* secured to the lid 3 is housed and fixed by adhesion flat in a corresponding depression 51 formed from the exterior surface of said lid, and of which the other end 50*b* secured to the base 2 has a straight edge or edge face in permanent and adhesive contact with the skirt 13 of said base. As shown by FIG. 1 in particular, the two ends 50*a* and 50*b* of the web 50 in the form of a tab each have a straight edge in contact with a corresponding straight edging formed in the skirt 13 of the base 2 or in the bottom of the depression 51 on the lid 3.

When the lid is in the wide open position shown in FIG. 2, that is to say at 180° about an axis determined by the hinge allowing the mouth free axis to the outlet orifice 10, there is no tension in the web 50.

When the lid is in the flipped-down position shown in FIG. 4, the exterior face of the web 50 is in tension, and the interior face is in compression about the same axis.

As FIG. 2 shows, an air intake is formed in the base 2. This air intake consists of at least one through-orifice 60. Preferably, two orifices 60 are formed through the annular rim 12 of this base 2. Air can thus enter the container when the liquid contained inside is discharged through the outlet orifice 10.

In order to seal this air intake, the lid 3 has closure means 61 which are separate from the shut-off means 16 and which allow the through-orifices 60 to be closed when the lid is in the flipped-down position.

The closure means 61 adopt the form of a cylindrical finger formed as an integral part of the interior face 15 of the lid 3 and having a free end 62.

For preference, the through-orifices 60 are housed in a recessed relief 65 formed in the annular rim 12 of the base 2. This relief 65 is of cylindrical shape with a depth that is shallow by comparison with the dimensions of the base 2. It has cylindrical walls 66 and a closed end 67. The orifices 60 are formed in the walls 66 transversely to the axis X-X of the stopper and are preferably situated on that part of these walls that faces a groove 70 described hereinafter. Air can thus enter the container 6 without passing through the user's mouth.

In order to shut off these orifices relative to the outside, the free end 62 of the finger 61 collaborates by nesting (FIG. 4), and in a way that is sealed with respect to the contents of the container, with the cylindrical walls 66 of the recessed relief 65. Thus, when the lid is in the flipped-down position, the contents of the container 6 are not contaminated by impurities entering via the through-orifices 60. Furthermore, the sealed closure of the orifices 60 also allows a certain gas pressure to be maintained in the container, something which is particularly advantageous before the contents of the container are first used, particularly in the case of a fizzy beverage.

As a preference also, the recessed relief 65 is situated near the foot 9 of the duct 8, and a groove 70 is formed on the exterior wall of the duct 8.

The groove 70 runs over the entire height of the duct 8 so that it opens into the recessed relief 65 at a lower end 71 and opens near the outlet orifice 10 at an upper end 72. Any liquid inadvertently escaping is automatically directed toward this groove because the through-orifices 60 are situated opposite it.

This groove 70 not only guides any drops of liquid that may have accidentally escaped via the through-orifices 60 toward the user's mouth but also allows air to enter the container 6 via the user's mouth, by passing through the upper end 72 of the groove 70.

With reference to FIGS. 7 to 10, the second embodiment of the invention differs from the first embodiment through the following technical characteristics:

- the base 2 comprises two obliquely extending more or less parallel external wings 81 and 82 forming between them a protected volume within which the flap 23 is able to pivot about its end 26 integral with the base 2 and the opposite end to the free end 27,
- the retaining means for locking the lid 3 on the base 2 comprise means achieving a tight fit that is sealed with respect to the contents of the container, these comprising a male part 83 belonging to the shut-off means 16 and consisting of the free end of the tubular element 32, and a mating corresponding female part 84 arranged in the outlet orifice 10 of the base 2 and consisting of a flexible skirt,
- for the air intake, at least one external groove 70 is formed on the base 2 and generally runs at the intersection between the latter and a more or less radial plane; more specifically, this groove 70 runs, on one side, at least from the foot 9 of the duct 8, for example from the intersection between the skirt 13 and the rest of the base 3, and, on the other side, along the duct 8 as far as the outlet orifice 10, the two ends 50*a* and 50*b* of the flange 5 each have a straight edge, contiguous with two corresponding flats formed in the base 2 and in the lid 3 respectively.

The third embodiment of the invention depicted in FIG. 11 differs from the second embodiment in that at least two sets, in this instance three sets, each consisting of several external grooves 70 as described hereinabove, are angularly offset from one another about the axis of the discharge duct 8.

Furthermore, means for tamper proofing the stopper, that is to say preventing it from being tampered with before it enters service, are also provided between the base 2 and the lid 3; they have not been depicted because they do not form part of the scope of the present invention.

The invention claimed is:

1. A stopper intended to be mounted on a container, an internal volume of which may contain contents capable of flowing, said stopper comprising:

a base comprising mounting means for mounting on the container, the container having a neck sealable with respect to the contents of said container, and a discharge duct designed to communicate with an internal volume of said container in order to discharge the contents, comprising an outlet orifice for letting said contents out, a lid comprising shut-off means designed to close the outlet orifice of the base in a way that is sealed with respect to the contents of said container, articulation means for articulating the lid with respect to the base, between an open position in which the outlet orifice of the base is completely uncovered, and a flipped-down position in which said outlet orifice is closed, the articulation means including a spring-back hinge comprising a piece or web of viscoelastic material, which joins the lid and the base, the spring-back hinge being designed to be stressed when the lid is in a flipped-down position onto the base, and being designed to automatically urge the lid to spring back to the open position, retaining means for locking the lid on the base, in the flipped-down position, the retaining means being designed to require a predetermined unlatching force, exerted between said lid and the base, in order to disengage one from the other and free the hinge to automatically urge the lid to spring back to the open position, and positive unlatching means for unlatching the lid from the base, the unlatching means being designed to be actuated manually by exerting an opposing force between said base and said lid, the opposing force being at least equal to the unlatching force of the retaining means that holds the lid in the flipped-down position, wherein when the unlatching means is manually actuated, the hinge is designed to automatically urge the lid to spring back to the open position, wherein the unlatching means comprises:

at least one ramp belonging to the lid or to the base, and a manually actuable elastic deformable flap formed as an integral part of the base, the manually actuable elastic deformable flap comprising a free end intended to slide along the ramp to create said opposing force, the ramp being disposed with respect to the free end of the flap so that when the flap is manually actuated, the ramp extends beyond a position of the ramp when the lid is in the flipped-down position, but disengaged from the base, and the ramp is formed as an integral part of the lid, wherein the ramp extends away from the base, and the portion of the ramp furthest from the base merges to a portion of the lid that is oriented parallel to the shut-off means, and wherein, when the lid is in the flipped-down position, the ramp extends outward and away from the base, the base comprises two more or less parallel and oblique external wings that project outwardly and away from the base, each wing having a top edge and a side edge and the wings forming between them a protected volume within which the flap can pivot about an end formed into the base, the end opposing the free end, and wherein the side edge of each wing extends no farther in a radial direction than a corresponding edge of the flap based upon a diametrical cross section of the stopper extending through a center of the spring-back hinge.

2. The stopper as claimed in claim 1, wherein the hinge comprises at least two articulation leaves situated one on either side of the web of viscoelastic material, and which are molded as an integral part of the lid and the base.

3. The stopper as claimed in claim 2, wherein the articulation leaves adhere respectively to the two lateral faces of the web.

4. The stopper as claimed in claim 2, wherein each articulation leaf comprises a central part and at least two articulation regions on each side of said central part.

5. The stopper as claimed in claim 1, wherein the retaining means for locking the lid on the base comprises clip-fastening means borne by the lid and complementary clip-fastening means borne by the base.

6. The stopper as claimed in claim 1, wherein the base comprises an air intake separate from the discharge duct, the air intake being designed to allow air to enter the container in response to the dispensing of the contents.

7. The stopper as claimed in claim 6, wherein the air intake comprises at least one through-orifice formed in the base, and the lid further comprises closure means, separate from the shut-off means, designed to shut off said through-orifice when the lid is in the flipped-down position.

8. The stopper as claimed in claim 6, wherein the air intake comprises at least one external groove formed on the base, which runs at the intersection thereof with a more or less radial plane, running on one side at least from a foot of the duct, and on the other side, along the discharge duct as far as the outlet orifice.

9. The stopper as claimed in claim 8, wherein the external groove runs from the intersection of a skirt with a remainder of the base.

10. The stopper as claimed in claim 1, wherein the web of viscoelastic material has two ends connected directly to the base and to the lid, respectively.

11. The stopper as claimed in claim 10, wherein an end of the web that is connected to the lid lies flat in a housing of said lid and/or of said base.

12. The stopper as claimed in claim 10, wherein an end of the web that is connected to the base adheres to said base via a straight edge.

13. The stopper as claimed in claim 10, wherein the two ends of the web each have a straight edge, contiguous with two corresponding flats formed in the base and in the lid, respectively.

14. The stopper as claimed in claim 10, wherein the stopper is obtained by molding or two-shot injection molding, respectively, of a thermoplastic that allows at least the base and the lid to be produced as one integral part.

15. The stopper as claimed in claim 1, the stopper further comprising:

means for accompanying the pivoting of the lid with respect to the base, the means for accompanying comprising a cradle formed on said base to accommodate a boss formed on the lid, the cradle defining an imaginary axis of rotation, toward the end of travel of the lid into the flipped-down position.

16. A container comprising or incorporating a stopper as claimed in claim 1, said stopper being positioned on a neck of said container.

17. The container as claimed in claim 16, the internal volume of which is filled with contents capable of flowing.

18. The stopper as claimed in claim 1, wherein the external wings have a slope that originates from lower ends of the external wings connected to the base towards upper ends of the external wings, the slope being in a same direction as a slope of the flap.

19. The stopper as claimed in claim 1, wherein the external wings have a curved surface that is substantially parallel to a curved surface of the base.

20. The stopper as claimed in claim 8, wherein the at least one external groove is a plurality of sets of external grooves.

21. The stopper as claimed in claim 20, wherein individual sets of external grooves of the plurality of external grooves are angularly offset from one another about an axis of the discharge duct.

22. A stopper intended to be mounted on a container, an internal volume of which may contain contents capable of flowing, said stopper comprising:

a base comprising mounting means for mounting on the container, the container having a neck sealable with respect to the contents of said container, and a discharge duct designed to communicate with an internal volume of said container in order to discharge the contents, comprising an outlet orifice for letting said contents out, a lid comprising shut-off means designed to close the outlet orifice of the base in a way that is sealed with respect to the contents of said container, articulation means for articulating the lid with respect to the base, between an open position in which the outlet orifice of the base is completely uncovered, and a flipped-down position in which said outlet orifice is closed, the articulation means including a spring-back hinge comprising a piece or web of viscoelastic material, which joins the lid and the base, the spring-back hinge being designed to be stressed when the lid is in a flipped-down position onto the base, and being designed to automatically urge the lid to spring back to the open position, retaining means for locking the lid on the base, in the flipped-down position, the retaining means being designed to require a predetermined unlatching force, exerted between said lid and the base, in order to disengage one from the other and free the hinge to automatically urge the lid to spring back to the open position, and positive unlatching means for unlatching the lid from the base, the unlatching means being designed to be actuated manually by exerting an opposing force between said base and said lid, the opposing force being at least equal to the unlatching force of the retaining means that holds the lid in the flipped-down position, wherein when the unlatching means is manually actuated, the hinge is designed to automatically urge the lid to spring back to the open position, wherein the unlatching means comprises:

at least one ramp belonging to the lid or to the base, and a manually actuable elastic deformable flap formed as an integral part of the base, the manually actuable elastic deformable flap comprising a free end intended to slide along the ramp to create said opposing force, the ramp being disposed with respect to the free end of the flap so that when the flap is manually actuated, the ramp extends beyond a position of the ramp when the lid is in the flipped-down position, but disengaged from the base, and the ramp is formed as an integral part of the lid, wherein the ramp extends away from the base, and the portion of the ramp furthest from the base merges to a portion of the lid that is oriented parallel to the shut-off means, and wherein when the lid is in the flipped-down position, the ramp extends outward and away from the base, the base comprises two more or less parallel and oblique external wings that project outwardly and away from the base, each wing having a top edge and a side edge and the wings forming between them a protected volume within which the flap can pivot about an end formed into the base, the end opposing the free end, wherein the external wings are at the same radius as, and are substantially flush with, the flap, and wherein the side edge of each wing extends no farther in a radial direction than a corresponding edge of the flap based upon a diametrical cross section of the stopper extending through a center of the spring-back hinge.

23. A stopper intended to be mounted on a container, an internal volume of which may contain contents capable of flowing, said stopper comprising:

a base comprising mounting means for mounting on the container, the container having a neck sealable with respect to the contents of said container, and a discharge duct designed to communicate with an internal volume of said container in order to discharge the contents, comprising an outlet orifice for letting said contents out, a lid comprising shut-off means designed to close the outlet orifice of the base in a way that is sealed with respect to the contents of said container, articulation means for articulating the lid with respect to the base, between an open position in which the outlet orifice of the base is completely uncovered, and a flipped-down position in which said outlet orifice is closed, the articulation means including a spring-back hinge comprising a piece or web of viscoelastic material, which joins the lid and the base, the spring-back hinge being designed to be stressed when the lid is in a flipped-down position onto the base, and being designed to automatically urge the lid to spring back to the open position, retaining means for locking the lid on the base, in the flipped-down position, the retaining means being designed to require a predetermined unlatching force, exerted between said lid and the base, in order to disengage one from the other and free the hinge to automatically urge the lid to spring back to the open position, wherein the retaining means for locking the lid on the base comprises means for achieving a tight fit, the means for achieving the tight fit comprising a male part belonging to the shut-off means and a matching corresponding female part in the outlet orifice of the base, and positive unlatching means for unlatching the lid from the base, the unlatching means being designed to be actuated manually by exerting an opposing force between said base and said lid, the opposing force being at least equal to the unlatching force of the retaining means that holds the lid in the flipped-down position, wherein when the unlatching means is manually actuated, the hinge is designed to automatically urge the lid to spring back to the open position, wherein the unlatching means comprises:

at least one ramp belonging to the lid or to the base, and a manually actuable elastic deformable flap formed as an integral part of the base, the manually actuable elastic deformable flap comprising a free end intended to slide along the ramp to create said opposing force, the ramp being disposed with respect to the free end of the flap so that when the flap is manually actuated, the ramp extends beyond a position of the ramp when the lid is in the flipped-down position, but disengaged from the base, and the ramp is formed as an integral part of the lid, wherein the ramp extends away from the base, and the portion of the ramp furthest from the base merges to a portion of the lid that is oriented parallel to the shut-off means, and wherein, when the lid is in the flipped-down position, the ramp extends outward and away from the base, the base comprises two more or less parallel and oblique external wings that project outwardly and away from the base, each wing having a top edge and a side edge and the wings forming between them a protected volume within which the flap can pivot about an end formed into the base, the end opposing the free end, and wherein the side edge of each wing extends no farther in a radial direction than a corresponding edge of the flap based upon a diametrical cross section of the stopper extending through a center of the spring-back hinge.

* * * * *